US005306528A

United States Patent [19]

Bruehs

[11] Patent Number: 5,306,528

[45] Date of Patent: Apr. 26, 1994

[54] PRECISION FLUID DELIVERY SYSTEM WITH RAPID SWITCHING CAPABILITY

[75] Inventor: Walter A. Bruehs, Webster, N.Y.

[73] Assignee: Eastman Kodak Company, Rochester, N.Y.

[21] Appl. No.: 976,223

[22] Filed: Nov. 13, 1992

[51] Int. Cl.[5] ..... B05D 1/26; B05D 1/30

[52] U.S. Cl. ..... 427/420; 118/302; 118/410; 118/DIG. 4

[58] Field of Search ..... 118/410, 411, 302, 697, 118/704, DIG. 4; 427/420

[56] References Cited

U.S. PATENT DOCUMENTS

| | | | |
|---|---|---|---|
| 2,795,206 | 6/1957 | Faber | 118/704 |
| 3,145,930 | 8/1964 | Herklotz et al. | 118/302 |
| 3,166,438 | 1/1965 | Wampler et al. | 118/302 |
| 3,205,853 | 9/1965 | Wampler et al. | 118/302 |
| 3,348,774 | 10/1967 | Wiggins | 118/302 |
| 3,385,522 | 5/1968 | Kock | 118/302 |
| 3,450,092 | 6/1969 | Kock | 118/302 |
| 3,477,870 | 11/1969 | Boretti et al. | 118/697 |
| 3,637,136 | 1/1972 | Bok | 118/302 |
| 3,674,207 | 7/1972 | Carbonetti, Jr. et al. | 118/697 |
| 3,973,961 | 8/1976 | Ströszynski | 118/410 |
| 4,038,442 | 7/1977 | Utumi | 427/128 |
| 4,050,410 | 9/1977 | Stroszynski | 118/410 |
| 4,337,282 | 6/1982 | Springer | 427/421 |
| 4,375,865 | 3/1983 | Springer | 222/135 |
| 4,440,811 | 4/1984 | Hitaka et al. | 118/410 |
| 4,457,258 | 7/1984 | Cocks | 118/694 |
| 4,555,416 | 11/1985 | Fights et al. | 118/302 |
| 4,592,305 | 6/1986 | Scharfenberger | 118/677 |
| 4,623,501 | 11/1986 | Ishizaki | 118/410 |
| 4,704,296 | 11/1987 | Leanna et al. | 427/9 |
| 4,771,729 | 9/1988 | Plannert et al. | 118/697 |
| 4,797,304 | 1/1989 | Sugita | 118/203 |
| 4,830,887 | 5/1989 | Reiter | 427/420 |
| 4,881,563 | 11/1989 | Christian | 118/302 |
| 4,962,724 | 10/1990 | Prus et al. | 118/688 |
| 4,979,380 | 12/1990 | Robbins et al. | 118/323 |
| 4,982,687 | 1/1991 | Takahashi et al. | 118/410 |

*Primary Examiner*—Shrive Beck
*Assistant Examiner*—Katherine A. Bareford
*Attorney, Agent, or Firm*—Carl F. Ruoff

[57] ABSTRACT

The present invention is a method for coating a plurality of coating compositions onto a moving support while minimizing the time required to switch from one coating composition to a different coating composition. The method involves supplying a first coating composition to a hopper at a first flowrate. When the switch is made to an alternate coating composition, the alternate coating composition is supplied to the hopper at a second flowrate while coating composition is removed from the hopper at a third flowrate equal to the first flowrate subtracted from the second flowrate. After sufficient pumping the alternate coating composition is supplied to the hopper at the first flowrate and no coating composition is removed from the hopper.

4 Claims, 3 Drawing Sheets

FIG. 3 shows the average coating laydown using piston pumps.

For a better understanding of the present invention, together with other advantages and capabilities thereof, reference is made to the following detailed description and appended claims in connection with the preceding drawings and description of some aspects of the present invention.

DETAILED DESCRIPTION OF THE PREFERRED EMBODIMENT

Figure 1:
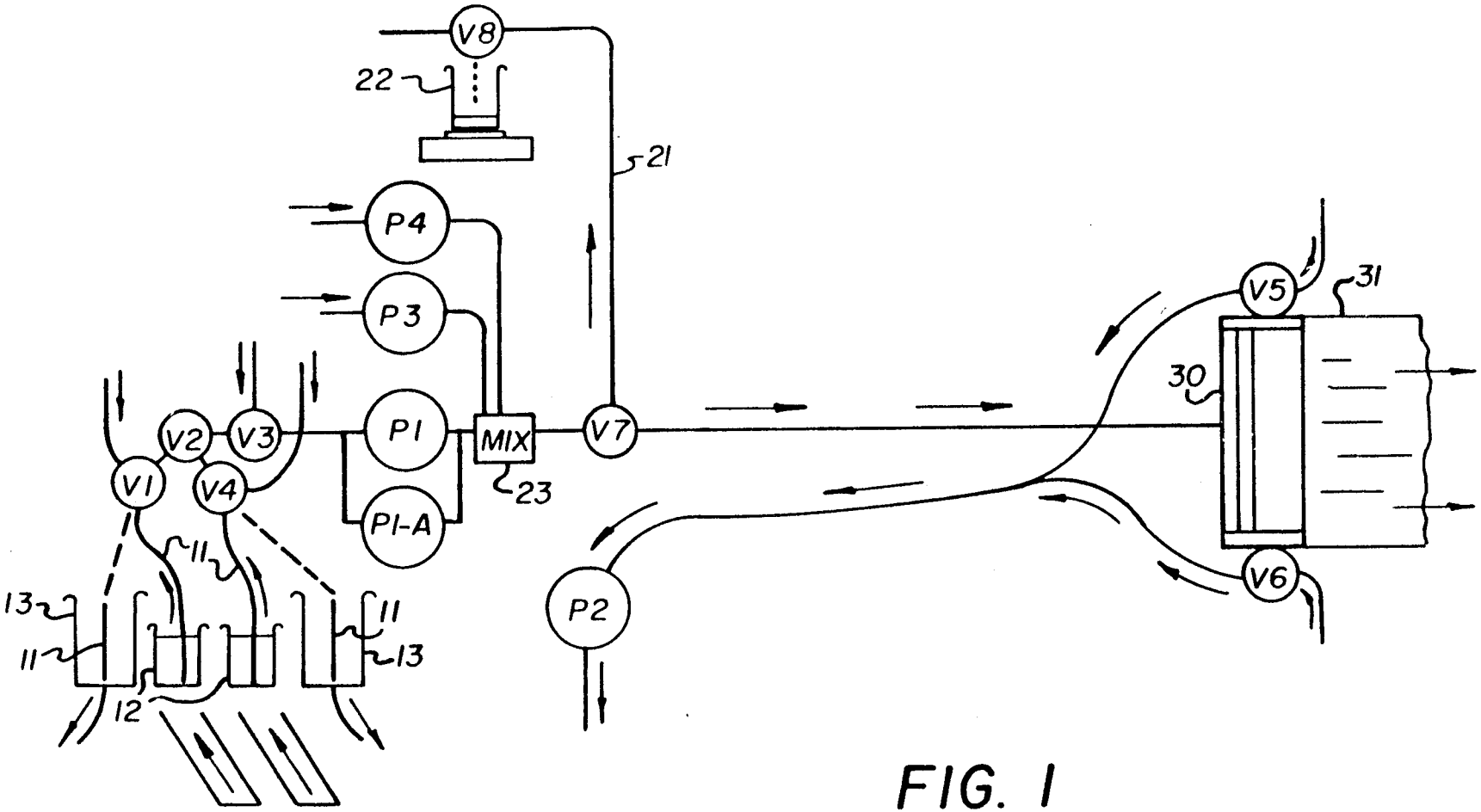

The present invention is a method which allows a coating operator to switch from one melt to the next without introducing air into the delivery system. In addition, cross-contamination from one melt to the next is minimized. The system used in the present invention is shown in FIG. 1.

Two so-called "suck wands" 11 (stainless steel tubes) are used alternately to draw in a coating composition. The coating composition is held in vessels 12. While one wand is sucking in the coating composition, the other wand is being washed in the suck wand wash station shown as 13 in FIG. 1. The inside of the wand is simultaneously flushed with water or gel solution. Each wand 11 is moved by pneumatic cylinders between either the wash station or the coating composition. Vessels 12 are held at 40° C. and magnetically stirred during coating. Microswitch or IR sensors are used in the system to insure that a vessel 12 is present before the suck wand 11 is inserted. The system accommodates most types of vessels. After coating, the vessels are pushed into a plastic bag for delivery to a building washing machine (not shown). Alternatively, the vessels can be dumped and washed prior to being pushed into a plastic bag.

The coating composition from vessel 12 is pumped through pump P1 and delivered to the hopper 30 at the normal coating flow rate, of for example 30 cc/min. For this example, pumps P3 and P4 which are connected to hardener vessels and other additive vessels, i.e. chemical addenda, are not active. The coating composition delivered to the hopper 30 is then applied to the web 31. At this time valves V5 and V6 are closed and all of the coating composition delivered to the hopper 30 is subsequently coated on the web 31.

When the switchover to the next coating composition is initiated, pump P1A starts pumping at a rate of, for example, 200 cc/min. Pump P1 is switched to the next coating composition and continues pumping at 30 cc/min. The total flow going into the hopper then becomes 230 cc/min, as pump P1 has not stopped pumping or changed speed. Valves V5 and V6 are opened when pump 1A begins pumping. Pump 2 is started simultaneously with pump 1A. The result is that 200 cc/min is sucked out the ends of the hopper while 30 cc/min continues to be delivered to the web. Therefore, the bead is never broken. No human intervention is required. After a predetermined volume of fluid has passed through the system, a volume judged to be sufficient for purging, pump P1A stops valves V5 and V6 close off and pump P2 continues to pump flush water to drain at a slow rate. Pump P1 never changes speed through all of these sequences. It continues to deliver the normal coating flow.

When pumps P3 and P4 are used with this system, their flow during purging will be maintained at a constant ratio to the stream being delivered by pumps P1 and P1A.

The purge volume is conveniently expressed in terms of system volumes. One system volume is the volume of the tubing, the pump, the valves, the mixer and the hopper. This is defined as the volume of the inlet means and the volume of the hopper. Usually an acceptable purge can be achieved by passing three system volumes through the hopper. In a preferred embodiment of the present invention the system as shown in FIG. 1 is controlled by a computer control system (not shown). All the timing, valve switching and calibration functions are controlled by the computer control system. In addition, all of the components, both computer and pumps, reside on a portable cart. This portability yields two important benefits. It facilitates delivery system construction without disrupting ongoing coating operations and it allows the system to be tested on a variety of coating machines. For a given experiment the operator enters the aim flow rate (cc/min), the number of coatings in the experiment, the number of "good" feet of the coating he wants to produce, etc. After these parameters are entered, the operator initiates the system and feeds the melt vessels to the delivery system and applies labels to the web when prompted by the computer controls. The hopper remains in the coating position at all times.

FIG. 1 also includes a calibration line 21 leading to a weigh station 22 for calibrating pumps P1, P1-A, P3 and P4. During calibration valve V7 directs flow through line 21 to the weigh station 22. The pumps can be calibrated with this configuration.

The pumps, P1, P1A, P2, P3, P4 used are reciprocating piston pumps manufactured by Fluid Metering Inc. These pumps use ceramic pistons inside of ceramic cylinders and have dialable strokes. The pump sizes available have strokes of 0.01 to 0.05 cc/revolution, 0.01 to 0.10 cc/revolution and 0.02 to 0.32 cc/revolution. These pumps deliver linear fluid flow over the range of 0 to 2500 rpm and are rated to 100 psi.

The stepper motors used to control the pumps are available from Seiberco Motors. The pump motor combination was tested over the 50 to 2500 rpm range. It was found to have a standard fluid delivery error of approximately ±0.2%. Although these were the pumps used with the present system, other pumps and motors can be substituted.

The mixing chamber 23 used is a visco-coupled mixer element that operates at approximately 800 rpm. One of the concerns in the present system was the use of reciprocating piston pumps. The concern was that cross-lines might appear on the coating. The tests run have shown that cross-lines disappear when the single stroke volumes are small and the stroke frequency is high. In tests using the pumps of the present invention, cross-lines disappeared when the pulse frequency was above approximately 275 pulses/min. This corresponds to a 10 cc/ft$^2$ laydown at 30 ft/min web speed. The example below gives the predicted crossline intervals for three cases. The objective was to make a 4 inch wide coating at three web speeds, 10, 30 and 90 ft/min. One pump was used to deliver the total flow.

| CASE 1: | | |
|---|---|---|
| Web speed | 10 | fpm |
| Wet laydown | 10 | cc/ft$^2$ |
| Required flow rate | 33.33 | cc/min. |
| FMI pump head is dialed to deliver | 0.01333 | cc/rev. |
| Pump speed | 2500 | rpm |
| Predicted cross-line interval | 0.048 | inches |

-continued

| | | |
|---|---|---|
| CASE 2: | | |
| Web speed | 30 | fpm |
| Wet laydown | 8 | cc/ft$^2$ |
| Required flow rate | 80.0 | cc/min. |
| FMI pump head is dialed to deliver | 0.032 | cc/rev. |
| Pump speed | 2500 | rpm |
| Predicted cross-line interval | 0.144 | inches |
| CASE 3: | | |
| Web speed | 90 | fpm |
| Wet laydown | 6 | cc/ft$^2$ |
| Required flow rate | 180 | cc/min. |
| FMI pump head is dialed to deliver | 0.072 | cc/rev. |
| Pump speed | 2500 | rpm |
| Predicted cross-line interval | 0.432 | inches |

None of the above cases produced detectable cross-lines. When multiple pumps are used, for example having the hardener and addenda pumps in use, higher pulsation frequencies result which smooth fluid flow even further. The high frequency pulses are readily dampened by the rubber delivery lines.

Figure 2:
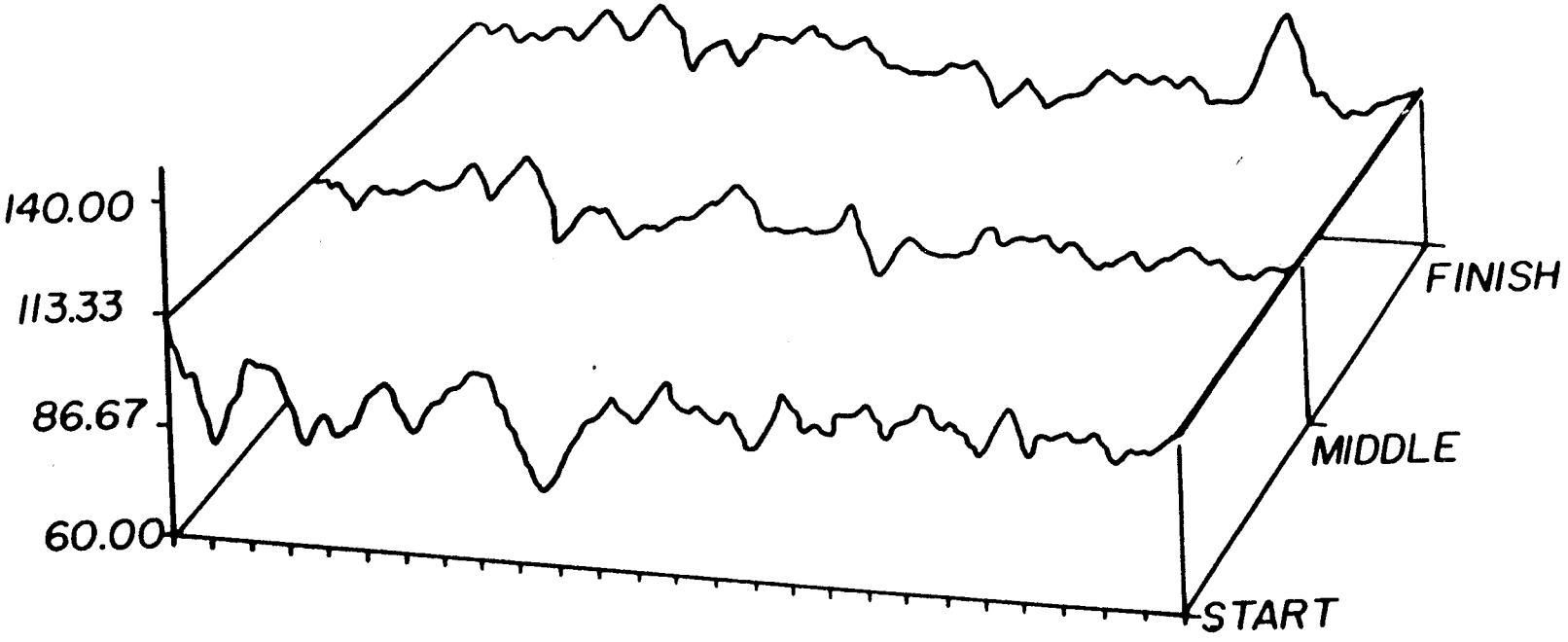
Figure 3:
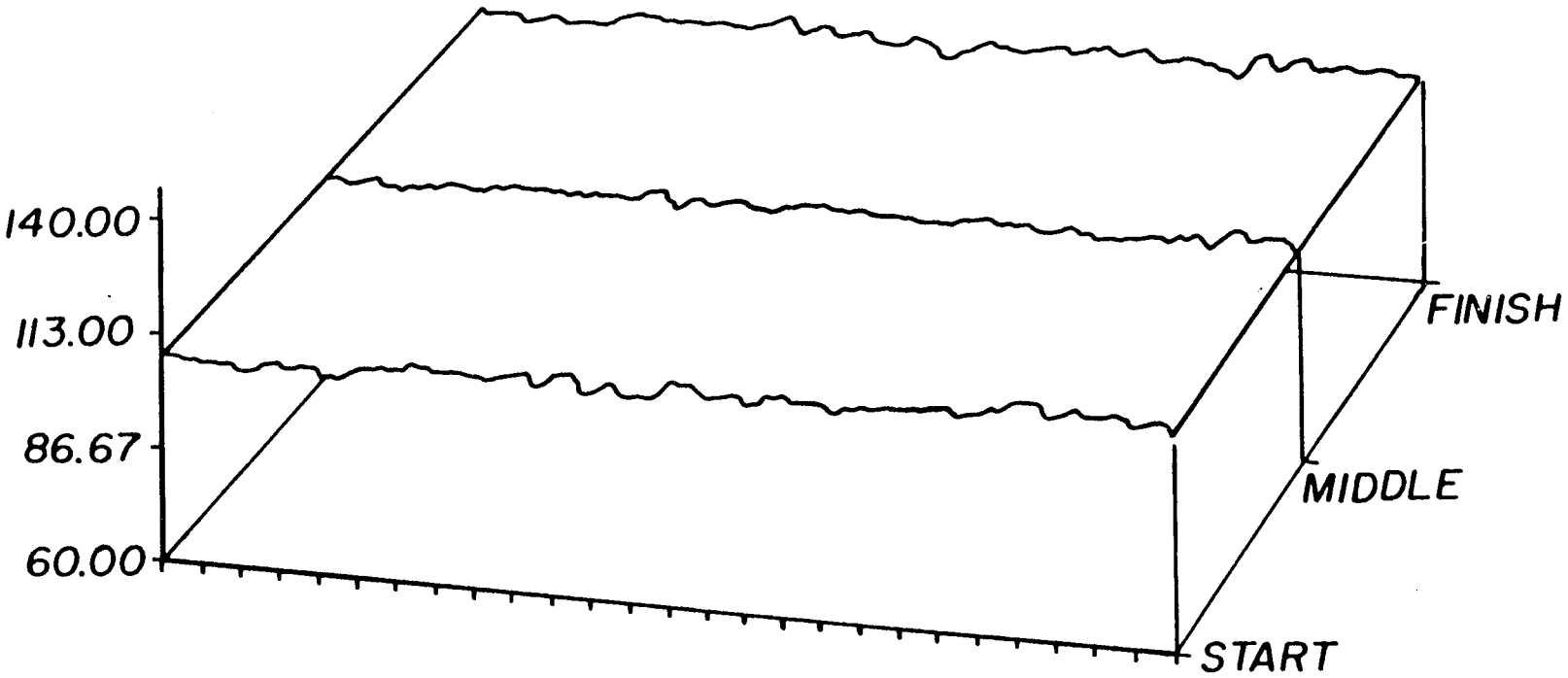

Shown in FIG. 2 is the average laydown of a coating when using conventional (balloon method) pumps. This is compared with the piston pump method of the present invention which is shown in FIG. 3. As can be seen from a comparison of FIGS. 2 and 3, significantly improved fluid delivery precision was achieved. In addition, no cross-lines were detected and rapid melt changeovers were achieved while the coating bead was essentially undisturbed during the purging operation.

Although the invention has been described as using a purge mode wherein the flow rate is greater than the flow rate that is used during normal coating operations, it is also possible to purge at the same flow rate, that is the flow rate equal to the coating flow rate. This is not the preferred procedure. Actual procedures may vary depending upon the coating machine.

Shown in Table I is a predicted increase in productivity when using the present invention. Examples 1 through 5 show the number of feet of a good coating required, the number of coatings produced per hour using conventional methods and the coatings per hour and percent productivity gain that can occur using the method of the present invention. As can be seen from Table I, productivity increases of 200 to 1200% are possible when using the method of the present invention.

TABLE I

| | | | Tubing I.D. 0.125 Inches | | Tubing I.D. 0.0625 Inches | |
|---|---|---|---|---|---|---|
| Exmpl | Final Feet | Present Ctgs/hr | Potentl Ctgs/hr | Potentl Percent Prdctvy Gain | Potentl Ctgs/hr | Potentl Percent Prdctvy Gain |
| 1 | 15 | 20 | 179 | 895% | 246 | 1230% |
| 2 | 15 | 30 | 179 | 597% | 246 | 820% |
| 3 | 9 | 60 | — | — | 339 | 565% |
| 4 | 30 | 30 | 120 | 400% | 146 | 487% |
| 5 | 30 | 60 | 120 | 200% | 146 | 243% |

Ex. 1–3 had web speed of 10 ft/min, wet coverage of 10 cc/ft$^2$.

Ex. 4 had web speed of 30 ft/min, wet coverage of 8 cc/ft$^2$.

Ex. 5 had web speed of 90 ft/min, wet coverage of 6 cc/ft$^2$.

While there has been shown and described what are at present considered preferred embodiments of the invention, it will be obvious to those skilled in the art that various changes, alterations and modifications may be made therein without departing from the scope of the invention as defined by the appended claims.

What is claimed is:

1. A method of switching from a first coating composition to a second coating composition comprising:

providing a moving substrate;

providing a coating hopper having a cavity, a slot in fluid communication with the cavity, inlet means in fluid communication with the cavity and outlet means in fluid connection with the cavity wherein coating composition flows through the slot and is deposited on said substrate via a coating bead or a coating curtain;

supplying the first coating composition to the inlet means at a first volumetric flowrate;

switching to the second coating composition by supplying the second coating composition to the inlet means for a time at a second volumetric flowrate larger than the first volumetric flowrate while discharging from the outlet means coating composition at a third volumetric flowrate, the third flowrate being equal to the first flowrate subtracted from the second flowrate wherein the coating bead or coating curtain is maintained at the first flowrate and wherein coating composition discharged through the outlet means is not deposited on said substrate; and thereafter supplying the second coating composition to the inlet means at the first volumetric flowrate while preventing flow out of the outlet means.

2. The method according to claim 1 wherein the time is such that at least three system volumes are passed through the cavity, wherein the system volume includes the internal volume of the coating hopper and inlet means.

3. A method of coating a plurality of coating compositions comprising:

a) providing a moving support;

b) providing a coating hopper having a cavity, a slot in fluid communication with the cavity, an inlet means in fluid communication with the cavity and an outlet means in fluid communication with the cavity wherein coating composition flows through the slot and is deposited on said substrate via a coating bead or coating curtain;

c) supplying one of the plurality of coating compositions to the inlet means at a first volumetric flowrate;

d) switching to an alternate coating composition by supplying a second one of the plurality of coating compositions to the inlet means for a time at a second volumetric flowrate larger than the first volumetric flowrate while discharging from said outlet means coating composition from the cavity at a third volumetric flowrate, the third flowrate being equal to the first flowrate subtracted from the second flowrate wherein the coating bead or coating curtain is maintained at the first flowrate and wherein coating composition discharged through the outlet means is not deposited on said substrate;

e) thereafter supplying the coating composition from step (d) to the inlet means at the first rate;

f) repeating steps (d) through (f) for each of the plurality of coating compositions.

4. The method according to claim 3 wherein the time of step (d) is such that at least three system volumes are passed through the cavity, wherein the system volume includes the internal volume of the hopper and inlet means.

* * * * *